US011067249B2

(12) United States Patent
Martinez Weber et al.

(10) Patent No.: US 11,067,249 B2
(45) Date of Patent: Jul. 20, 2021

(54) OPTICAL SYSTEM

(71) Applicant: ANTARES ILUMINACION, S.A.U., Valencia (ES)

(72) Inventors: Federico Martinez Weber, Valencia (ES); Marinella Patetta, Valencia (ES); Claudio Valent, Valencia (ES)

(73) Assignee: ANTARES ILUMINACION, S.A.U., Valencia (ES)

( * ) Notice: Subject to any disclaimer, the term of this patent is extended or adjusted under 35 U.S.C. 154(b) by 0 days.

(21) Appl. No.: 16/981,548

(22) PCT Filed: Mar. 16, 2018

(86) PCT No.: PCT/ES2018/070202
§ 371 (c)(1),
(2) Date: Sep. 16, 2020

(87) PCT Pub. No.: WO2019/175445
PCT Pub. Date: Sep. 19, 2019

(65) Prior Publication Data

US 2021/0018158 A1 Jan. 21, 2021

(51) Int. Cl.

| | |
|---|---|
| ***F21V 7/00*** | (2006.01) |
| ***F21V 5/04*** | (2006.01) |
| ***F21Y 115/10*** | (2016.01) |
| ***F21S 8/02*** | (2006.01) |

(52) U.S. Cl.
CPC ..... *F21V 7/0041* (2013.01); *F21V 5/045* (2013.01); *F21V 7/0091* (2013.01); *F21S 8/02* (2013.01); *F21Y 2115/10* (2016.08)

(58) Field of Classification Search
None
See application file for complete search history.

(56) References Cited

U.S. PATENT DOCUMENTS

| | | | |
|---|---|---|---|
| 2007/0263390 | A1 | 11/2007 | Timinger et al. |
| 2011/0170298 | A1 | 7/2011 | Anaokar et al. |

FOREIGN PATENT DOCUMENTS

| | | | |
|---|---|---|---|
| DE | 2201574 | A1 | 7/1973 |
| EP | 1617247 | A2 | 1/2006 |
| EP | 2469159 | A2 | 6/2012 |
| EP | 2924352 | A1 | 9/2015 |
| WO | 9101012 | A2 | 1/1991 |
| WO | 2009064275 | A1 | 5/2009 |
| WO | 2013142437 | A1 | 9/2013 |

*Primary Examiner* — Britt D Hanley
(74) *Attorney, Agent, or Firm* — Hayes Soloway PC

(57) ABSTRACT

The present invention discloses an optical system comprising:
- a light source (1);
- a reflection hood (2);
- a shielding cone (3) arranged below the reflection hood (2); and
- a double focus lens (4) arranged between the light source (1) and the shielding cone (3).

15 Claims, 2 Drawing Sheets

OPTICAL SYSTEM

CROSS-REFERENCE TO RELATED APPLICATIONS AND PRIORITY

This patent application claims priority from PCT Patent Application No. PCT/ES2018/070202 filed Mar. 16, 2018. This patent application is herein incorporated by reference in its entirety.

OBJECT OF THE INVENTION

The present invention relates to an optical system that enables wide shielding angles to be obtained but without the output loss associated with traditional parabolic optics.

The object of the invention is an optical system that prevents the problem of glare caused by directly viewing the light source at certain angles of observation without reducing the levels of light efficiency.

BACKGROUND OF THE INVENTION

Several types of optical systems are known in the prior art, such that for the arrangement thereof, preferably on ceilings, they have an anti-glare element usually in the shape of a truncated cone, that cover the luminaire radially and they enable the light to pass through said truncated cone. This type of barrier focuses the light towards a specific point and the shape thereof prevents glare in the most efficient manner.

However, to perform maintenance on this type of luminaire, there is less space and the insertion of the luminaire with this anti-glare element into existing holes tends to be complex.

There are other types of solutions for preventing the user from being able to see the light directly and being blinded by the intensity thereof. One potential solution to this possible glare is the arrangement of the luminaires in holes arranged in the ceiling, such that the user, when looking from a certain angle, does not see the luminaire directly but can see the light that shines therefrom. To prevent glare, a shielding cone is used in front of the primary optics in this type of luminaire. However, this has a significant effect on the light output of the optics, which decreases considerably when said cone absorbs many light beams that would otherwise leave the optics assembly if it did not exist.

The optical system of the present invention ensures that the light beam does not blind the user at the same time that it prevents the light output of the optics from being low.

DESCRIPTION OF THE INVENTION

The optical system of the present invention prevents the problem of glare caused by directly viewing the light source at certain angles of observation without reducing the levels of light efficiency.

For the purpose of solving the problems existing in the luminaires of the prior art, the present invention discloses an optical system comprising:

- a light source;
- a reflection hood;
- a shielding cone arranged below the reflection hood; and
- a double focus lens arranged between the light source and the shielding cone.

Throughout the present specification, when the shielding cone is mentioned it is not only limited to a geometric cone shape, but said term also includes the geometric truncated cone shape.

Preferably, the double focus lens arranged between the light source and the shielding cone is at least partially arranged inside the reflection hood.

The optical system thus constituted ensures that the glare is limited by means of the shielding cone that defines a shielding angle or cut-off angle, such that if the point of observation (position of the observer) is within said shielding angle or cut-off angle, it is not possible to see the light source directly.

Moreover, due to the double focus lens arranged between the light source and the shielding cone, the light beams emitted by the light source do not shine on the inside of the shielding cone, such that the light output is not affected, since said cone does not absorb said light beams.

The reflection hood enables most light beams coming from the light source to be redirected, while the double focus lens enables a second virtual focus or new intersection of light beams, preferably in a position below the shielding cone, to be created, which prevents internal reflections in the shielding cone that the observer could perceive even within the shielding angle or cut-off angle. This double focus lens can be used in both open beam optics as well as closed beam optics.

Preferably, the angle of the shielding cone or cutoff angle is greater than 30°, such that it reduces the shielding as much as possible.

DESCRIPTION OF THE DRAWINGS

As a complement to the description provided herein, and for the purpose of helping to make the characteristics of the invention more readily understandable, in accordance with a preferred practical exemplary embodiment thereof, said description is accompanied by a set of drawings constituting an integral part thereof which, by way of illustration and not limitation, represent the following.

PREFERRED EMBODIMENT OF THE INVENTION

The optical system of the present invention is described in detail below.

The optical system comprises:

- a light source (1);
- a reflection hood (2);
- a shielding cone (3) arranged below the reflection hood (2); and
- a double focus lens (4), preferably in the shape of a double parabola, wherein the two parabolas are arranged in such a way that the vertices of said parabolas are the farthest points from each other, wherein the double focus lens (4) is arranged between the light source (1) and the shielding cone (3).

The double focus lens (4) arranged between the light source (1) and the shielding cone (3) is at least partially arranged inside the reflection hood (2), as shown in the exemplary embodiments that are explained below and shown in FIGS. 1 to 5.

Figure 1:
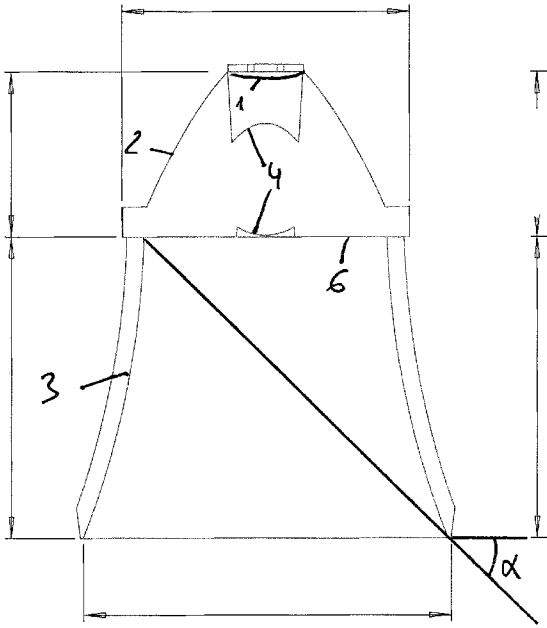
FIG. 1 shows a schematic view of the optical system of the present invention for a first exemplary embodiment.

In a first exemplary embodiment shown in FIG. 1, the optical system comprises the light source (1), preferably an LED, the reflection hood (2) that in turn comprises a flat bottom surface (6) and the shielding cone (3) arranged below the reflection hood (2).

In this first exemplary embodiment, the optical system further comprises the double focus lens (4) in the shape of a double parabola arranged between the light source (1) and the shielding cone (3), wherein said double focus lens (4) is completely contained in the reflection hood (2), more specifically arranged on the flat bottom surface (6), the double focus lens (4) being arranged adjacent to an upper end (7) of the shielding cone (3).

Figure 2:
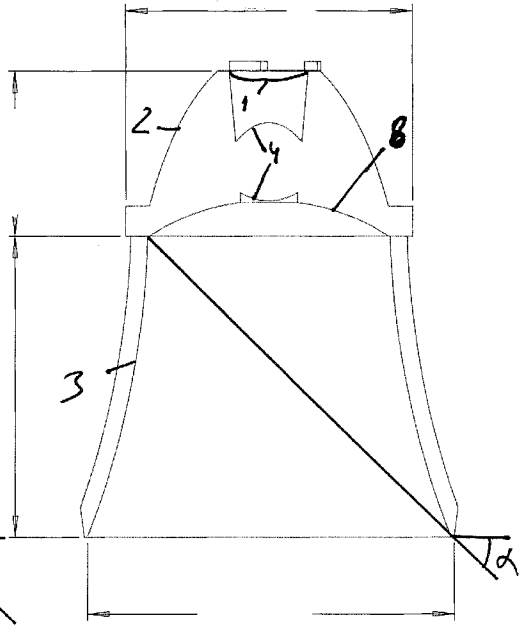
FIG. 2 shows a schematic view of the optical system of the present invention for a second exemplary embodiment.

In a second exemplary embodiment shown in FIGS. 2 and 4, the optical system comprises the light source (1), preferably an LED, the reflection hood (2) that in turn comprises a bottom surface (8) curved towards the inside of said reflection hood (2) and the shielding cone (3) arranged below the reflection hood (2).

In this second exemplary embodiment, the optical system further comprises the double focus lens (4) in the shape of a double parabola arranged between the light source (1) and the shielding cone (3), wherein said double focus lens (4) is completely contained in the reflection hood (2), more specifically arranged on the bottom surface (8) curved towards the inside of said reflection hood (2).

Figure 3:
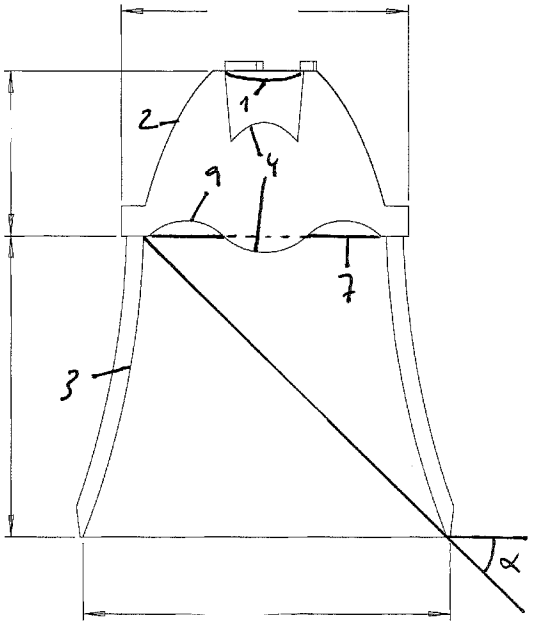
FIG. 3 shows a schematic view of the optical system of the present invention for a third exemplary embodiment.

In a third exemplary embodiment shown in FIGS. 3 and 5, the optical system comprises the light source (1), preferably an LED, the reflection hood (2) that in turn comprises a corrugated bottom surface (9) and the shielding cone (3) arranged below the reflection hood (2).

In this third exemplary embodiment, the optical system further comprises the double focus lens (4) in the shape of a double parabola arranged between the light source (1) and the shielding cone (3), wherein said double focus lens (4) is completely contained in the reflection hood (2), more specifically arranged on the corrugated bottom surface (9) that is inside the inner space of the shielding cone (3).

Figure 4:
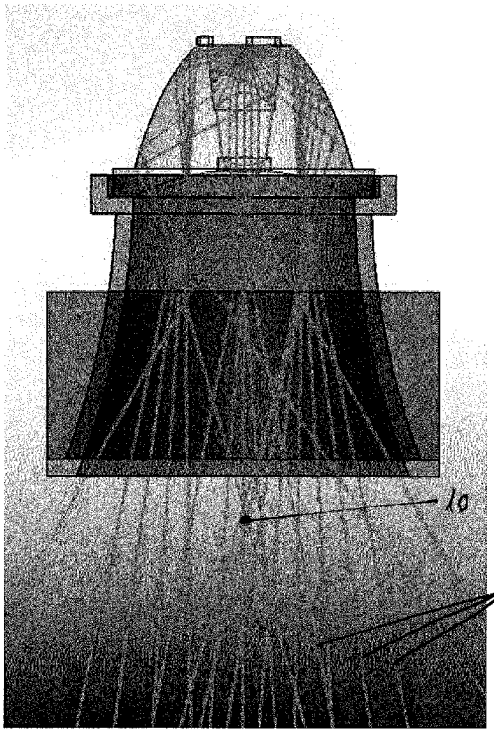
FIG. 4 shows a schematic view of the set of light beams obtained with the optical system of FIG. 2.
Figure 5:
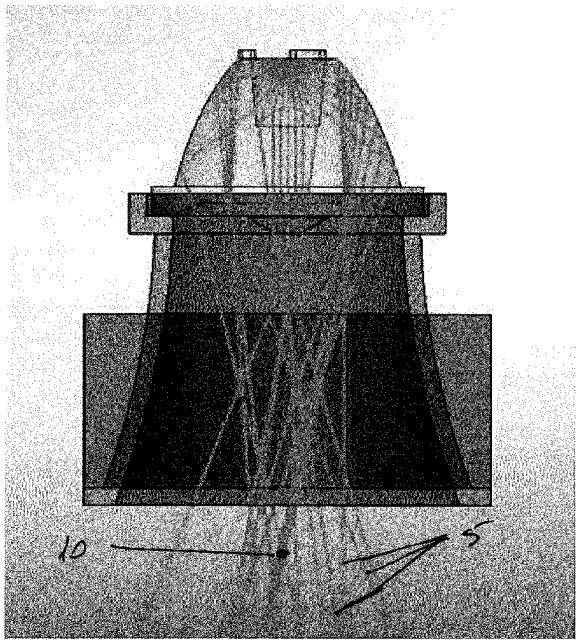
FIG. 5 shows a schematic view of the set of light beams obtained with the optical system of FIG. 3.

As shown in FIGS. 4 and 5 corresponding to the second and third exemplary embodiments, respectively, due to the fact that the double focus lens (4) is at least partially arranged between the light source (1) and the shielding cone (3), the light beams (5) emitted by the light source (1) do not shine on the inside of the shielding cone (3), such that the light output is not affected, since said shielding cone does not absorb said light beams.

Likewise, FIGS. 4 and 5 show that the reflection hood (2) enables the majority of light beams (5) coming from the light source (1) to be redirected, while the double focus lens (4) enables the creation of a second virtual focus (10) or new intersection of light beams, in a position below the shielding cone (3), in other words, away from it (3), which prevents internal reflections in the shielding cone that the observer could perceive even within the shielding angle ($\alpha$) or cut-off angle.

The angle of the shielding cone ($\alpha$) or cutoff angle is greater than 30° for the examples shown, preferably greater than 45°, such that shielding is reduced as much as possible.

The invention claimed is:

1. An optical system comprising:

a light source;

light beams emitted by the light source;

a reflection hood;

a shielding cone arranged below the reflection hood; and a double focus lens arranged between the light source and the shielding cone which creates an intersection of the light beams in a position below the shielding cone.

2. The optical system of claim 1, wherein the double focus lens arranged between the light source and the shielding cone is at least partially arranged inside the reflection hood.

3. The optical system of claim 1, wherein the double focus lens has the shape of a double parabola, wherein the two parabolas are arranged in such a way that the vertices of said parabolas are the farthest points from each other.

4. The optical system of claim 1, wherein the reflection hood in turn comprises a flat bottom surface, wherein the double focus lens is completely contained in the reflection hood, arranged on the flat bottom surface, the double focus lens being arranged adjacent to an upper end of the shielding cone.

5. The optical system of claim 1, wherein the reflection hood in turn comprises a bottom surface curved towards the inside of said reflection hood, wherein the double focus lens is completely contained in the reflection hood, arranged on the bottom surface curved towards the inside of said reflection hood.

6. The optical system of claim 1, wherein the reflection hood comprises a corrugated bottom surface, wherein the double focus lens is completely contained in the reflection hood, arranged on the corrugated bottom surface that is inside the inner space of the shielding cone.

7. The optical system of claim 1, wherein the shielding cone defines a shielding angle greater than 30.

8. The optical system of claim 2, wherein the double focus lens has the shape of a double parabola, wherein the two parabolas are arranged in such a way that the vertices of said parabolas are the farthest points from each other.

9. The optical system of claim 2, wherein the reflection hood in turn comprises a flat bottom surface, wherein the double focus lens is completely contained in the reflection hood, arranged on the flat bottom surface, the double focus lens being arranged adjacent to an upper end of the shielding cone.

10. The optical system of claim 3, wherein the reflection hood in turn comprises a flat bottom surface, wherein the double focus lens is completely contained in the reflection hood, arranged on the flat bottom surface, the double focus lens being arranged adjacent to an upper end of the shielding cone.

11. The optical system of claim 2, wherein the reflection hood in turn comprises a bottom surface curved towards the inside of said reflection hood, wherein the double focus lens is completely contained in the reflection hood, arranged on the bottom surface curved towards the inside of said reflection hood.

12. The optical system of claim 3, wherein the reflection hood in turn comprises a bottom surface curved towards the inside of said reflection hood, wherein the double focus lens is completely contained in the reflection hood, arranged on the bottom surface curved towards the inside of said reflection hood.

13. The optical system of claim 2, wherein the reflection hood comprises a corrugated bottom surface, wherein the double focus lens is completely contained in the reflection hood, arranged on the corrugated bottom surface that is inside the inner space of the shielding cone.

14. The optical system of claim 3, wherein the reflection hood comprises a corrugated bottom surface, wherein the double focus lens is completely contained in the reflection hood, arranged on the corrugated bottom surface that is inside the inner space of the shielding cone.

15. The optical system of claim 1, wherein the shielding cone defines a shielding angle greater than 45°.

* * * * *